US007108103B2

(12) United States Patent
Meeker

(10) Patent No.: US 7,108,103 B2
(45) Date of Patent: Sep. 19, 2006

(54) RIGIDIFIED STEP LADDER

(75) Inventor: Paul K. Meeker, Hiram, OH (US)

(73) Assignee: Cosco Management, Inc., Wilmington, DE (US)

( * ) Notice: Subject to any disclaimer, the term of this patent is extended or adjusted under 35 U.S.C. 154(b) by 15 days.

(21) Appl. No.: 10/443,373

(22) Filed: May 22, 2003

(65) Prior Publication Data

US 2004/0231920 A1 Nov. 25, 2004

(51) Int. Cl.
*E06C 1/00* (2006.01)

(52) U.S. Cl. ..... 182/165; 182/228.4

(58) Field of Classification Search ..... 182/165–176, 182/161, 194, 228.1–228.6, 180.1
See application file for complete search history.

(56) References Cited

U.S. PATENT DOCUMENTS

| | | | | |
|---|---|---|---|---|
| 872,165 | A * | 11/1907 | Adler | 182/219 |
| 1,045,957 | A * | 12/1912 | Dicks | 138/111 |
| 1,616,899 | A * | 2/1927 | Ingersoll | 182/228.3 |
| 1,806,502 | A * | 5/1931 | Rosenberg | 182/161 |
| 2,347,065 | A * | 4/1944 | Rigby | 182/177 |
| 2,533,391 | A * | 12/1950 | Miller | 182/25 |
| 2,633,376 | A * | 3/1953 | Foshee | 403/113 |
| 5,722,507 | A | 3/1998 | Kain | |
| 5,762,163 | A | 6/1998 | Kain | |
| 5,937,968 | A | 8/1999 | Gibson | |
| 6,026,933 | A | 2/2000 | King | |
| 6,039,149 | A | 3/2000 | Bedja | |
| 6,158,749 | A | 12/2000 | Roudebush | |
| 6,390,238 | B1 * | 5/2002 | Gibson et al. | 182/161 |
| 6,427,805 | B1 * | 8/2002 | Gibson et al. | 182/165 |
| 6,443,261 | B1 | 9/2002 | Gibson | |
| 6,454,050 | B1 | 9/2002 | Gibson | |
| 6,550,579 | B1 | 4/2003 | Gibson | |

FOREIGN PATENT DOCUMENTS

EP 437879 A1 * 7/1991

* cited by examiner

*Primary Examiner*—Alvin Chin-Shue
(74) *Attorney, Agent, or Firm*—Barnes & Thornburg LLP

(57) ABSTRACT

A step ladder includes rigidified left and right legs and step units between the legs. Each rigidified leg includes a web interconnecting first and second tubular members. Each step unit includes a hollow step including an internal rigidifying partition wall and step mounts for coupling the hollow step to the legs.

17 Claims, 5 Drawing Sheets

RIGIDIFIED STEP LADDER

BACKGROUND AND SUMMARY

The present disclosure relates to a ladder, and particularly to a collapsible ladder. More particularly, the present disclosure relates to a collapsible ladder including steps mounted on a frame.

Ladders have a frame and one or more steps that people use for elevation when reaching for objects, painting walls, or any everyday task where extra elevation would be helpful. Ladders are often foldable for ease of storage when the ladder is not being used.

According to the present disclosure, a step ladder includes left and right legs and several step units located in fixed positions between the legs. In an illustrative embodiment, each leg includes spaced-apart first and second tubular members and a web located between and coupled to the first and second tubular members so as to provide a rigidified leg.

Each step unit includes a hollow step, a left step mount for coupling a left end of the hollow step to the left leg, and a right step mount for coupling a right end of the hollow step to the right leg. The hollow step includes a horizontal top wall providing a step tread and a U-shaped base wall coupled to the horizontal top wall to form a hollow interior region therebetween. In an illustrative embodiment, the hollow step also includes a partition wall extending through the hollow interior region from the horizontal top wall to the U-shaped base wall to provide the step with a rigidified B-shaped cross-sectional shape. Each step mount has one side that is configured to mate with the first and second tubular members and to be coupled to the web located between those tubular members and an opposite side that is configured to mate with a distal end of the hollow step.

Additional features of the disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
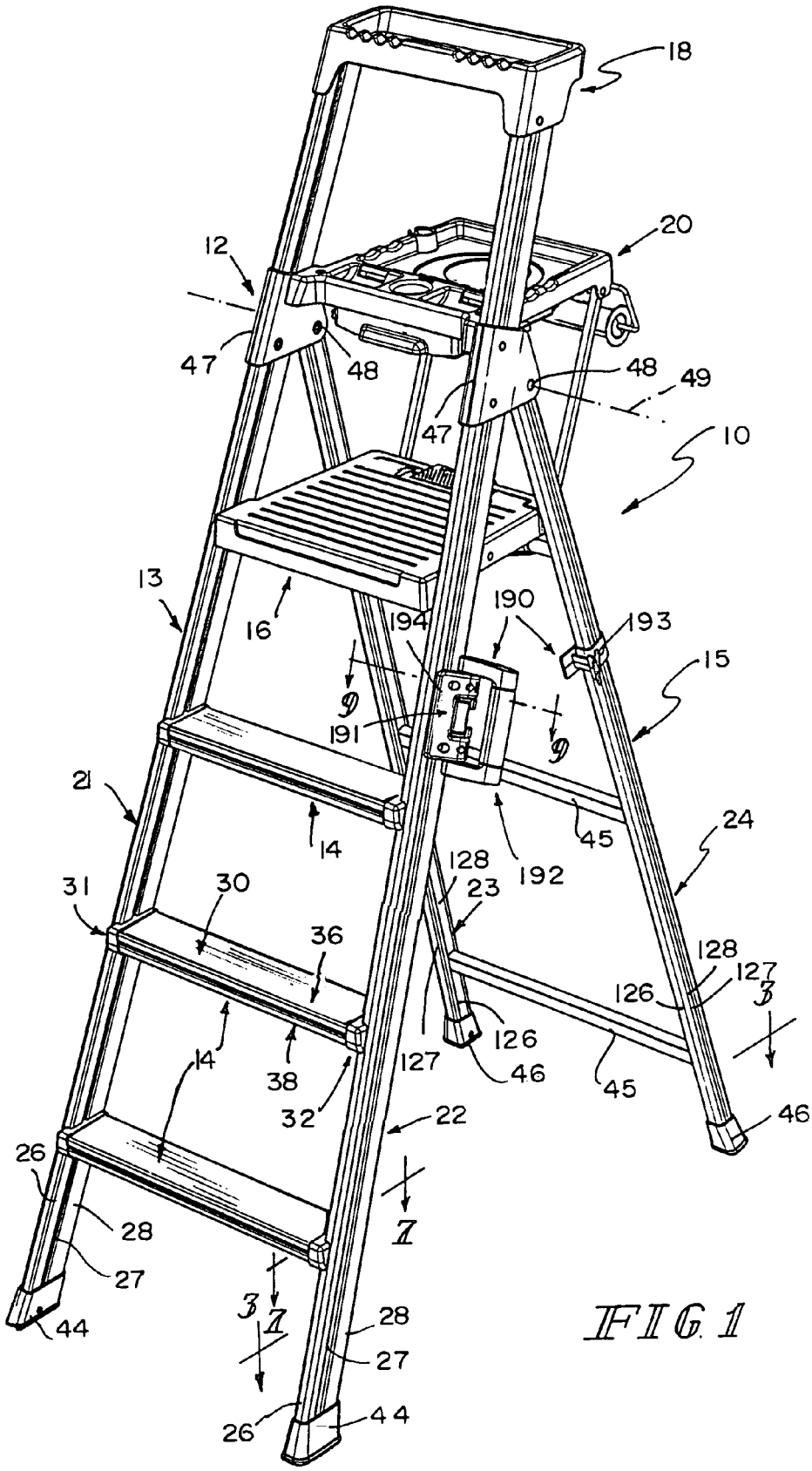
FIG. 1 is a perspective view of a step ladder in accordance with the present disclosure in an opened position showing an inclined front frame comprising left and right "double-tube" legs, three hollow step units coupled to the left and right double-tube legs of the inclined front frame, and an inclined rear frame comprising smaller left and right double-tube legs.

As shown in FIG. 1, step ladder 10 includes a frame 12, several step units 14 mounted on the frame 12, a top platform step 16, a fixed tray 18, and a movable tray 20 located between top platform step 16 and fixed tray 18. Frame 12 includes a front set of left and right legs 21, 22 and a rear set of left and right legs 23, 24. In the illustrated embodiment, step ladder 10 is collapsible and includes a pair of front legs 21, 22 and a pair of rear legs 23, 24. It is within the scope of this disclosure to provide a step ladder (not shown) omitting rear legs 23, 24, stretcher bars 45, platform 16, and movable tray 18.

Figure 2:
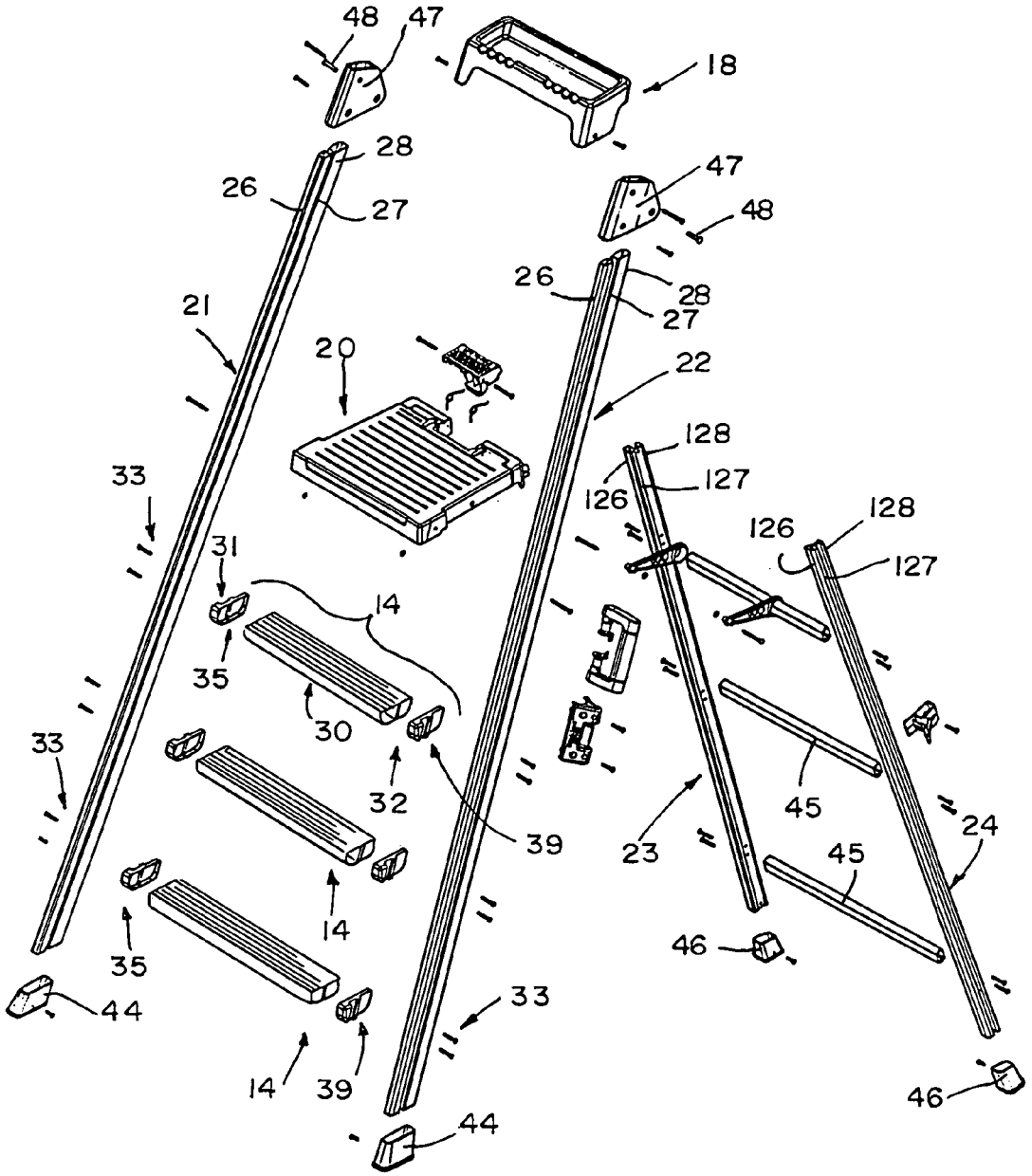
FIG. 2 is an exploded perspective view of some of the components included in the step ladder of FIG. 1 showing that each hollow step unit includes a step provided with a "B-shaped" cross-section and a pair of step mounts for coupling ends of each B-shaped step to the left and right double-tube legs.
Figure 3:
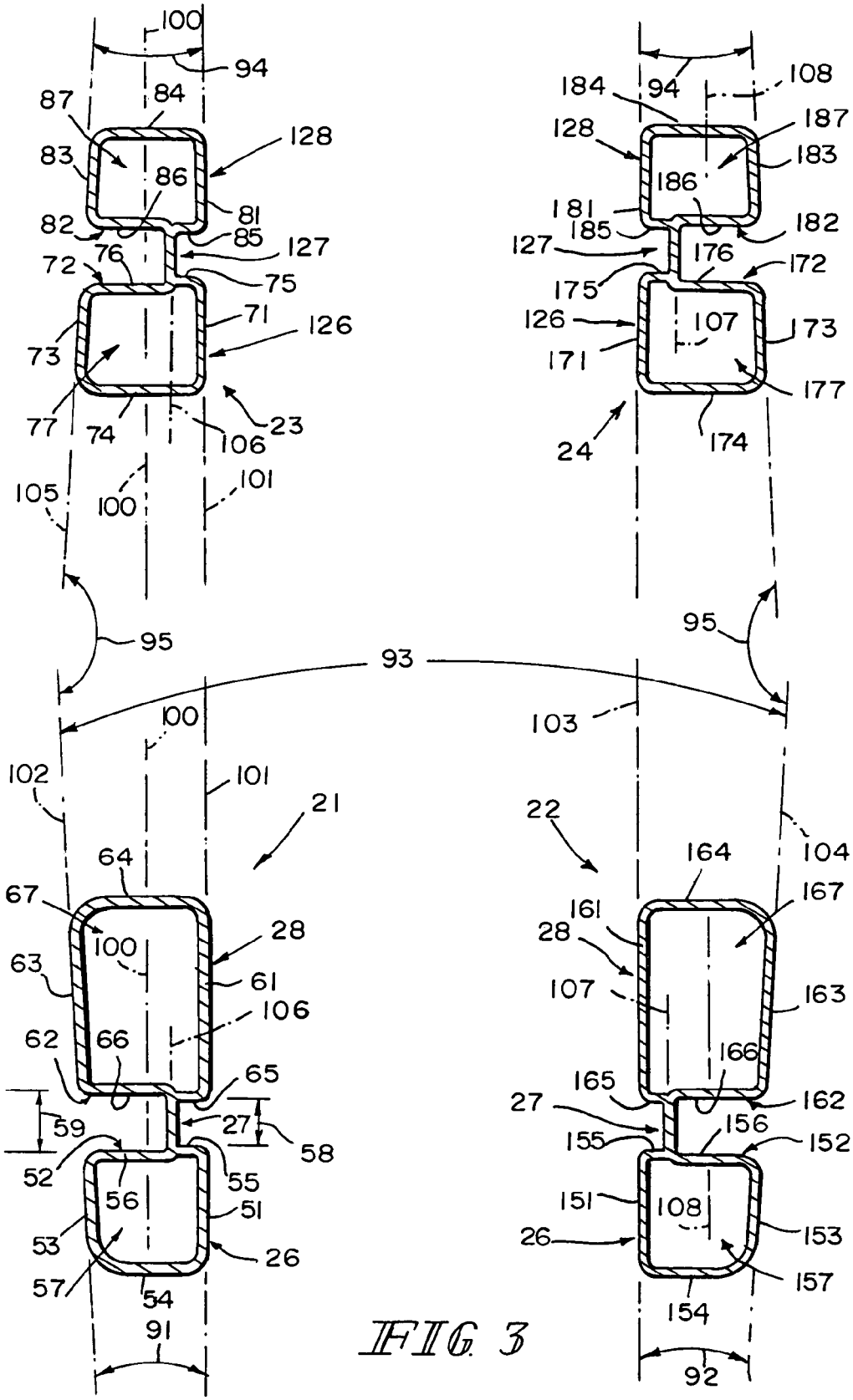
FIG. 3 is a sectional view taken along line 3—3 of FIG. 1 showing a cross-sectional shape of each of the four double-tube legs included in the step ladder of FIG. 1 wherein each leg comprises first and second tubular members and a web interconnecting the first and second tubular members.

As shown in FIGS. 2 and 3, each front leg 21 and 22 includes first and second tubular members 26, 28 and a web 27 located between and coupled to first and second tubular members 26, 28 so as to rigidify front legs 26, 28. Also, each rear leg 23 and 24 includes third and fourth tubular members 126, 128 and a web 127 located between and coupled to third and fourth tubular members 126, 128 to rigidify rear legs 23, 24.

Each of step units 14 includes a step 30 and a pair of step mounts 31, 32. Each of step mounts 31, 32 is configured to mate with one end of a step 30 and first and second tubular members 26, 28 of the leg 21 or 22 associated with the step mount. Fasteners 33 are used to anchor each step mount 31, 32 to one of the legs 21 or 22 to support the step 30 mated with the step mounts 31, 32 in a horizontally extending fixed position between left and right legs 21, 22.

Figure 4A:
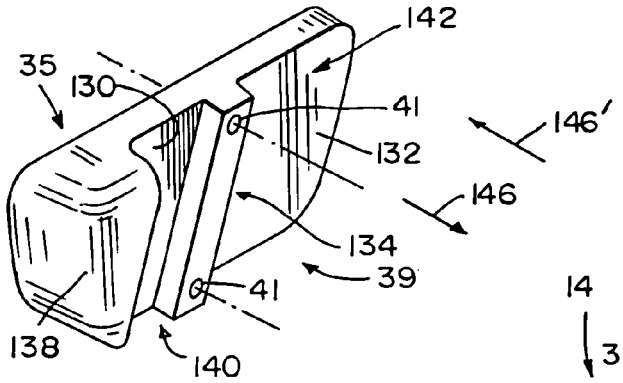
FIG. 4*a* is an enlarged perspective view of the step mount shown in FIG. 4 from a different point of view.
Figure 4:
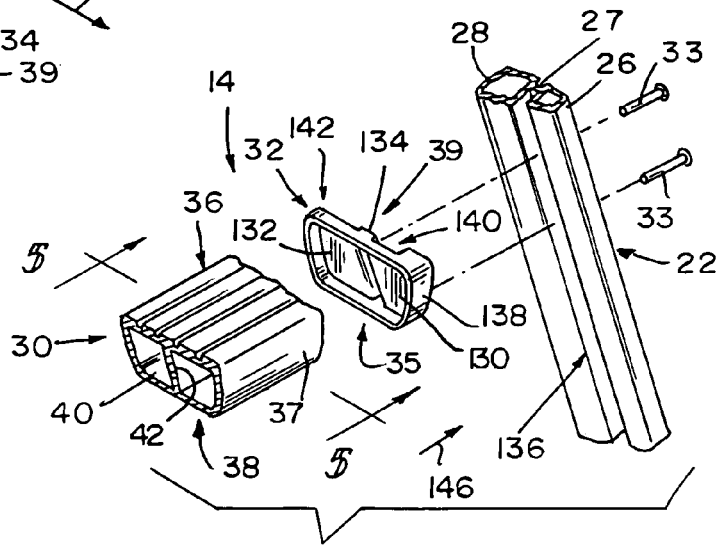
FIG. 4 is a perspective view of a portion of the front right double-tube leg, a portion of the middle B-shaped step, and a step mount adapted to be anchored to the front right double-tube leg and configured to receive a right end of the middle B-shaped step to support the step on the leg.
Figure 5:
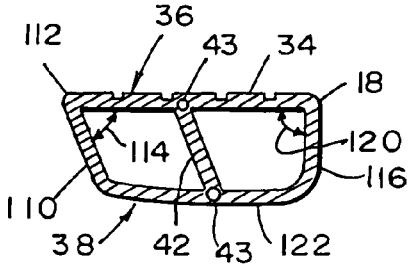
FIG. 5 is a section taken along line 5—5 of FIG. 4 showing a partition wall shared by horizontal tubular members cooperating to form the middle B-shaped step and formed to include a pair of fastener-receiving bores.

As suggested in FIGS. 2, 4, and 5, each step 30 is hollow and includes a horizontal top wall 34 providing a step tread 36, a U-shaped base 38 coupled to horizontal top wall 34 to form a hollow region 40 therebetween, and a partition wall 42. As shown best in FIG. 5, partition wall 42 extends from horizontal top wall 34 to U-shaped base wall 38 and substantially bisects hollow interior region 40 to provide step 30 with a rigidified, substantially B-shaped cross-sectional shape. It is within the scope of this disclosure to provide a step 30 omitting partition wall 42.

Each step mount 31, 32 is adapted to mate with one end of hollow step 30 and a portion of either leg 21 or leg 22 as suggested in FIGS. 1, 2, and 4. As suggested in FIGS. 4–6, an inner portion 35 of each step mount 31, 32 is formed to include means for receiving and mating with an end 37 of step 30. An outer portion 39 of each step mount 31, 32 is formed to include means for mating with web 27 and portions of first and second tubular members 26, 28 on either side of web 27 to allow fasteners 33 to pass through apertures 41 formed in web 27 and into bores 43 formed in partition wall 42 to anchor step 30 in a fixed position relative to said first and second tubular members 26, 28 and web 27.

As shown in FIGS. 1 and 2, frame 12 includes a front frame portion 13 and a rear frame portion 15 mounted for movement relative to front frame portion 13 between an expanded position (shown in FIG. 1) supporting front frame portion 13 in an inclined position and a collapsed position (not shown) lying alongside front frame portion 13. Front frame portion 13 includes left and right legs 21, 22 and leg end caps 44. Rear frame portion 15 includes left and right legs 23, 24, stretcher bars 45 interconnecting rear left and right legs 23, 24 and leg end caps 46. Rear frame portion 15 further includes pivot mounts 47 anchored in fixed positions on front left and right legs 21, 22 and coupled by means of pivot pins 48 to upper ends of rear left and right legs 23, 24 to support rear frame portion 15 for pivotable movement about pivot axis 49 relative to front frame portion 13.

Figure 9:
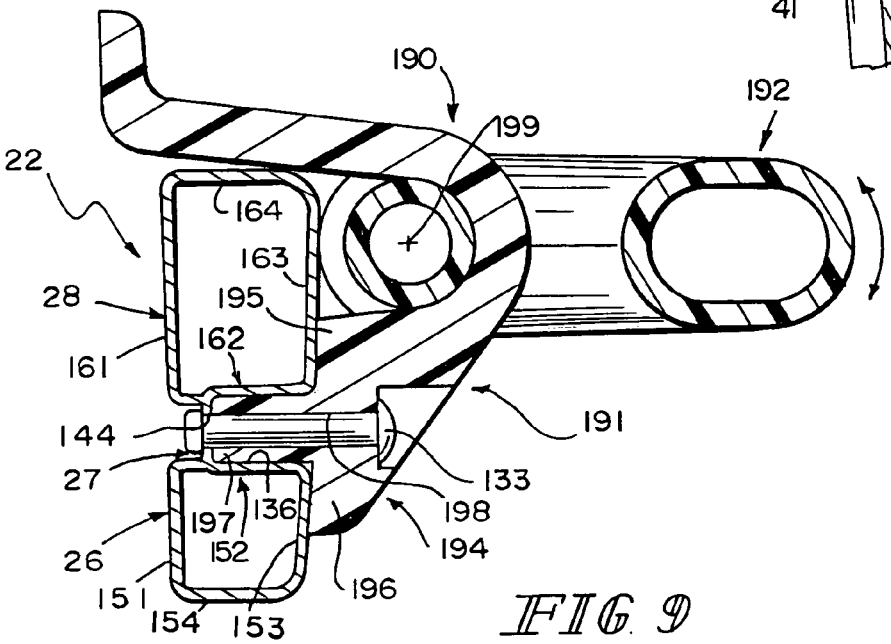
FIG. 9 is a section taken along line 9—9 of FIG. 1 showing a portion of the carrying handle mounted on the front right double-tube leg.

A carrier lock 190 is coupled to front and rear right legs 22, 24 in the manner suggested in FIGS. 2 and 9 to provide means for aligning and locking legs 22, 24 upon movement of legs 22, 24 to a side-by-side collapsed position (not shown). Carrier lock 190 also provides handle means for carrying the collapsed ladder 10. Carrier lock 190 includes a pivot support mount 191 coupled to front right leg 22 using a fastener 133 as shown in FIG. 9 and a handle 192 mounted for pivotable movement of pivot support mount 191. Carrier lock 190 further includes an alignment bracket 193 coupled to rear right leg 24 and adapted to mate with pivot support mount 191 upon movement of front and right rear legs 22, 24 to the side-by-side collapsed position.

As shown in FIG. 3, first tubular member 26 of front left leg 21 includes first side wall 51, second side wall 52, third side wall 53, and fourth side wall 54. Second side wall 52 includes a short wall portion 55 and a long wall portion 56. These four side walls 51, 52, 53 54 cooperate to form an interior region 57 therebetween. Likewise, first tubular member 26 of front right leg 22 includes first side wall 51, second side wall 152, third side wall 153, fourth side wall 154, short wall portion 155, long wall portion 156, and interior region 157. In the illustrated embodiment, the fist tubular members 26 of front left and right legs 21, 22 are mirror images of one another.

As shown in FIG. 3, second tubular member 28 of front left leg 21 includes first side wall 61, second side wall 62, third side wall 63, and fourth side wall 64. Second side wall 62 includes a short wall portion 65 and a long wall portion 66. These four side walls 61, 62, 63, 64 cooperate to form an interior region 67 therebetween. Likewise, second tubular member 28 of front right leg 22 includes first side wall 161, second side wall 162, third side wall 163, fourth side wall 164, short wall portion 165, long wall portion 166, and interior region 167. In the illustrated embodiment, the second tubular members 28 of front left and right legs 21, 22 are mirror images of one another.

In this disclosure, each of the rear left and right legs 23, 24 includes a pair of "tubular members." To promote clarity and to draw a distinction between the first and second tubular members included in each of the front left and right legs 21, 22, one of the tubular members in each of the rear left and right legs 23, 24 will be identified as a "third" tubular member and the other of the tubular members in each of the rear left and right legs 23, 24 will be identified as a "fourth" tubular member.

As shown in FIG. 3, third tubular member 126 of rear left leg 23 includes first side wall 71, second side wall 72, third side wall 73, and fourth side wall 74. Second side wall 72 includes a short wall portion 75 and a long wall portion 76. These four walls 71, 72, 73, 74 cooperate to form interior region 77 therebetween. Likewise, third tubular member 126 of rear right leg 24 includes first side wall 171, second side wall 172, third side wall 173, fourth side wall 174, short wall portion 175, long wall portion 176, and interior region 177. In the illustrated embodiment, the third tubular members 126 of rear left and right legs 23, 24 are mirror images of one another.

As shown in FIG. 3, fourth tubular member 128 of rear left leg 23 includes first side wall 81, second side wall 82, third side wall 83, and fourth side wall 84. Second side wall 82 includes short wall portion 85 and long wall portion 86. These four walls 81, 82, 83, 84 cooperate to form interior region 87 therebetween. Likewise, fourth tubular members 128 of right rear leg 24 includes first side wall 181, second side wall 182, third side wall 183, fourth side wall 184, short wall portion 185, long wall portion 186, and interior region 187. In the illustrated embodiment, the fourth tubular members 128 of rear left and right legs 23, 24 are mirror images of one another.

As suggested in FIG. 3, first side walls 51, 61 of first and second tubular members 26, 28 of front left leg 21 lie in coextensive relation with a first reference plane 101. Third side walls 53, 63 lie in coextensive relation with a second reference plane 102 that is oriented to cooperate with first reference plane 101 to define a first acute included angle 91 therebetween. In practice, these side walls may have a somewhat conical or arcuate shape. As used herein, "coextensive" means "having substantially the same spatial scope or boundaries" so that, e.g., both a flat side wall 51 or a slightly conical or arcuate side wall 51 could be said to lie in coextensive relation with reference to plane 101. Web 27 is arranged to lie closer to first reference plane 101 than to second reference plane 102 to lie in offset relation to a central reference plane 100 bisecting second side walls 56, 66 of first and second tubular members 26, 28 of front left leg 21.

Second side walls 56, 66 of first and second tubular members 26, 28 of front left leg 21 are coupled to web 27 located between those first and second tubular members 26, 28 as shown in FIG. 3. Short wall portion 55 is arranged to interconnect web 27 and first side wall 51 while short wall portion 65 is arranged to interconnect web 27 and first side wall 61. Short wall portions 55, 65 are arranged to lie in confronting relation to one another and are separated by a first distance 58. Long wall portion 56 is arranged to interconnect web 27 and third side wall 53 while long wall portion 66 is arranged to interconnect web 27 and third side wall 63. The relatively longer long wall portions 56, 66 are arranged to lie in confronting relation to one another and are separated by a second distance 59 that is greater than first distance 58.

As shown in FIG. 3, first side walls 151, 161 of first and second tubular members 26, 28 of front right leg 22 lie in coextensive relation with a third reference plane 103 that lies in spaced-apart parallel relation to first reference plane 101. Third side walls 153, 163 lie in coextensive relation with a fourth reference plane 104 that is oriented to cooperate with third reference plane 103 to define a second acute included angle 92 therebetween. In practice, these side walls may have a somewhat conical shape. First acute included angle 91 is substantially equivalent to second acute included angle 92. Fourth reference plane 104 is oriented to cooperate with second reference plane 102 to define a third acute included angle 93 therebetween.

Second side walls 156, 166 of front right leg 22 are coupled to web 27 as shown in FIG. 3. Short wall portion 155 is arranged to interconnect web 27 and first side wall 151 while short wall portion 165 is arranged to interconnect web 27 and first side wall 161. Short wall portions 155, 165 are arranged to lie in confronting relation to one another and are separated by first distance 58. Long wall portion 156 is arranged to interconnect web 27 and third side wall 153 while long wall portion 166 is arranged to interconnect web 27 and third side wall 163. The relatively longer long wall portions 156, 166 are arranged to lie in confronting relation to one another and are separated by second distance 59.

Each of the first, second, third, and fourth tubular members 26, 28, 126, 128 has a different size and cross-sectional shape in the embodiment illustrated in FIG. 3. Interior region 57 of first tubular member 26 has a volume that is less than the volume of interior region 67 of second tubular member 28 yet greater than the volumes of interior regions 77, 87 of third and fourth tubular members 126, 128. Interior region 77 of third tubular member 26 has a volume that is greater than the volume of interior region 87 of fourth tubular member 128. FIG. 3 is a scaled drawing and shows relative sizes, shapes, and walls of all tubular members accurately in accordance with a presently preferred embodiment.

Continuing to refer to FIG. 3, it will be seen that first side walls 51, 61, 71, 81 of first, second, third, and fourth tubular members 26, 28, 126, 128 of front and rear left legs 21, 23 lie in coextensive relation with first reference plane 101. Third side walls 73, 83 lie in coextensive relation with a fifth reference plane 105 that is oriented to cooperate with first reference plane 101 to define a third acute included angle 94 therebetween and to cooperate with second reference plane 102 to define an obtuse included angle 95 therebetween. Each of webs 27, 127 of front and rear left legs 21 and 23 is oriented to lie in coextensive relation with a sixth reference plane 106 and each of webs 27, 127 of front and rear right legs 22, 24 is oriented to lie in coextensive relation with a seventh reference plane 107 as also shown in FIG. 3. Sixth reference plane 106 is oriented to lie in offset relation to central reference plane 100 as shown in FIG. 3. Seventh reference plane 107 is oriented to lie in offset relation to a central reference plane 108 bisecting second side walls 156, 66, 176, 186 of first, second, third, and fourth tubular members 26, 28, 126, 128 of front and rear right legs 22, 24 as shown in FIG. 3.

Hollow steps 30 are shown, for example, in FIGS. 1, 2, 4, 5, 7, and 8. As shown best in FIG. 5, a rear portion 110 of U-shaped base wall 38 is positioned to lie in spaced-apart parallel relation to partition wall 42. Rear portion 110 is coupled to a rear edge 112 of horizontal top wall 36 and cooperates with wall 36 to define an acute included angle 114 therebetween. A front portion 116 of U-shaped base wall 38 is coupled to a front edge 118 of horizontal top wall 36 to define an acute included angle 120 therebetween. Front and rear portions 116, 110 of U-shaped base wall 38 are arranged to diverge in a direction toward horizontal top wall 36 a shown, for example, in FIG. 5. In the illustrated embodiment, U-shaped base wall 38 further includes a center portion 122 interconnecting front and rear portions 116, 110 and mating with partition wall 42. Center portion 122 is somewhat curved in cross-section and has a concave surface facing toward horizontal top wall 36 as shown in FIG. 5.

Figure 6:
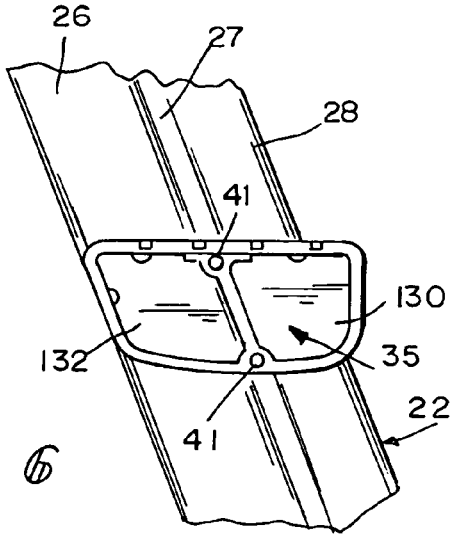
FIG. 6 is a side elevation view of the step mount of FIG. 4 anchored in place on the portion of the front right double-tube leg of FIG. 4.

Each step mount 31, 32 includes a first plate 130, a second plate 132, and a mount anchor 134 positioned to lie between first and second plates 130, 132 as suggested in FIGS. 4, 4*a*, and 6. When the step mount 31, 32 is mounted on a leg 21 or 22, first plate 130 is arranged to abut a companion first tubular member 26, second plate 132 is arranged to abut a companion second tubular member 28, and mount anchor 134 is positioned to extend into an anchor-receiving channel 136 defined by the companion first and second tubular members 26, 28 and the web 27 located between the companion first and second tubular members 26, 28 as suggested in FIGS. 4, 6, and 7.

As suggested in FIGS. 4 and 4*a*, each step mount 31, 32 further includes a mount flange 138 positioned to lie in spaced-apart relation to mount anchor 134 to locate at least a portion of first plate 130 therebetween. Mount flange 138, first plate 130, and mount anchor 134 cooperate to define a first tube channel 140 for receiving a portion of the first tubular member 26 associated with the selected step mount 31 or 32 therein as shown best in FIG. 7. The mount anchor 134 and second plate 132 of each step mount 31, 32 are oriented relative to one another to define a second tube channel 142 for receiving a portion of the second tubular member 28 associated with the selected step mount 31 or 32 therein as also shown best in FIG. 7.

Figure 7:
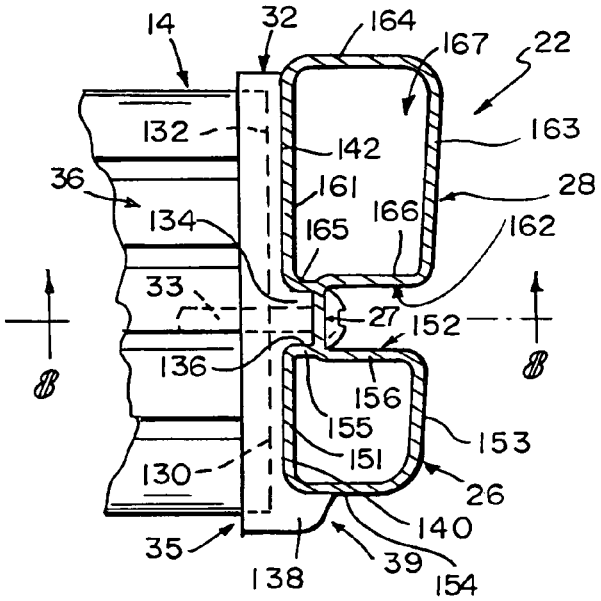
FIG. 7 is a section taken along line 7—7 of FIG. 1 showing a step mount located between the front right double-tube leg and the B-shaped step coupled to that step mount.
Figure 8:
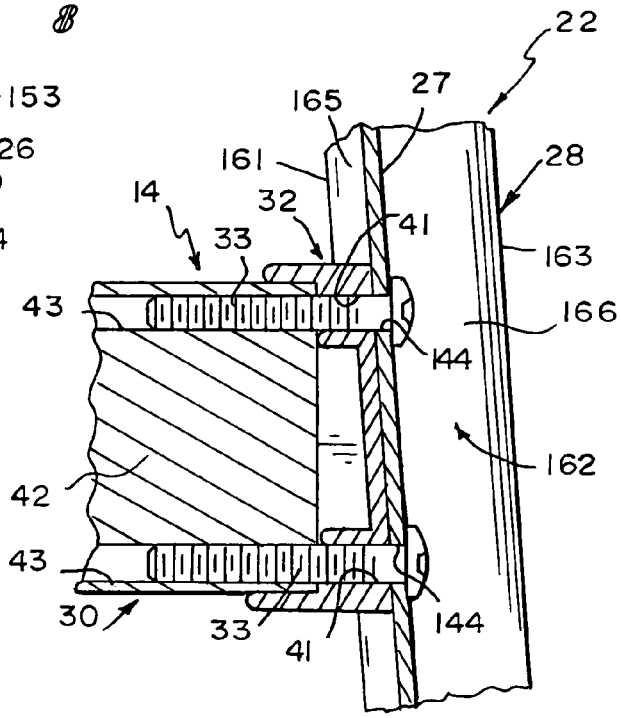
FIG. 8 is a section taken along line 8—8 of FIG. 7 showing fasteners arranged to anchor the step mount shown in FIG. 7 to the front right double-tube leg and engagement of the step mount with its companion B-shaped step.

As shown best in FIGS. 7 and 8, anchor mount 134 is arranged to abut web 27. Web 27 is formed to include fastener-receiving apertures 144 and anchor mount 134 is formed to include fastener-receiving apertures 41. Fasteners 33 are arranged to extend through these apertures 41, 144 and into bores 43 formed in partition wall 42 of hollow step 30 (to provide means for mating with a distal portion of fasteners 33) to anchor step 30 and its companion step mount 31 or 32 in a fixed position on the companion leg 21 or 22.

Anchor mount 134 extends away from first and second plates 130, 132 in a first direction 146 as suggested in FIGS. 4 and 4*a*. Each step mount 31, 32 also includes a rim 148 that extends away from first and second plates 130, 132 in an opposite second direction 146' as suggested in FIG. 4 to define chamber means for receiving one end of the step 30 associated with the step mount 31 or 32 so that the step mount is located in a fixed position on the step 30. Partition wall 42 of step 30 is arranged to extend along and in alignment with the mount anchor 134 of each step mount 31, 32 coupled to such step 30 as suggested in FIGS. 2 and 4.

As shown in FIG. 9, pivot support mount 191 of carrier lock 190 includes a base 194 having a first base portion 195 arranged to abut third side wall 163 of second tubular member 28 of front right leg 22 and a second base portion 196 arranged to abut third side wall 153 of first tubular member 26 of front right leg 22. Base 194 also includes a mount anchor 197 positioned to lie between first and second base portions 195, 196 and to extend into an anchor-receiving channel 136 defined by the companion first and second tubular members 26, 28 and the web 27 located between the companion first and second tubular members 26, 28 as suggested in FIG. 9. Mount anchor 197 and base 194 are formed to include a fastener-receiving passageway 198 as shown in FIG. 9 and this passageway 198 is aligned with a fastener-receiving aperture 144 formed in web 27 so that fastener 133 can pass therethrough and anchor base 194 in a fixed position relative to front right leg 22 as shown in FIG. 9. Handle 192 is mounted to pivot about pivot axis 199 relative to pivot support mount 191 as suggested in FIG. 9.

The invention claimed is:

1. A step ladder comprising a frame including a left leg and a right leg, each of the left and right legs including spaced-apart first and second tubular members and a web located between and coupled to the first and second tubular members, and a plurality of step units arranged to lie between the left and right legs, each step unit being coupled to the left and right legs to support said step unit in a stationary position relative to the left and right legs, wherein each of the first and second tubular members of the left leg includes first, second, third, and fourth side walls arranged in series to define an interior region therebetween and wherein the first side walls of said first and second tubular members lie in coextensive relation with a first reference plane, the second side walls of the said first and second tubular members are coupled to the web located between the first and second tubular members, and the third side walls of said first and second tubular members lie in coextensive relation with a second reference plane that is oriented to cooperate with the first reference plane to define a first acute included angle therebetween.

2. The step ladder of claim 1, wherein the web is arranged to lie closer to the first reference plane than to the second reference plane to lie in offset relation to a central reference plane bisecting the second side walls of said first and second tubular members.

3. The step ladder of claim 1, wherein portions of the second side walls of said first and second tubular members are located in spaced-apart parallel relation to one another.

4. The step ladder of claim 1, wherein the second side wall of each of said first and second tubular members includes a short wall portion arranged to interconnect the web and the first side wall of said first tubular member and a relatively longer long wall portion arranged to interconnect the web and the third side wall, the short wall portions of said first and second tubular members are arranged to lie in confronting relation to one another and are separated by a first distance, the long wall portions of said first and second tubular members are arranged to lie in confronting relation to one another and are separated by a second distance that is greater than the first distance.

5. The step ladder of claim 4, wherein the short wall portions of said first and second tubular members are arranged to lie in spaced-apart parallel relation to one another and the long wall portions of said first and second tubular members are arranged to lie in spaced-apart parallel relation to one another.

6. The step ladder of claim 1, wherein each of the first and second tubular members of the right leg includes first, second, third, and fourth side walls arranged in series to define an interior region therebetween, the first side walls of the first and second tubular members of the right leg lie in coextensive relation with a third reference plane that lies in spaced-apart parallel to the first reference plane, the second side walls of the first and second tubular members of the right leg are coupled to the web located between the first and second tubular members of the right leg, and the third side walls of the first and second tubular members of the right leg lie in coextensive relation with a fourth reference plane that is oriented to cooperate with the third reference plane to define a second acute included angle therebetween.

7. The step ladder of claim 6, wherein the first acute included angle is substantially equivalent to the second acute included angle.

8. The step ladder of claim 6, wherein the fourth reference plane is oriented to cooperate with the first reference plane to define a third acute included angle therebetween.

9. The step ladder of claim 1, wherein at least one of the step units is hollow and includes a horizontal top wall, a U-shaped base wall coupled to the horizontal top wall to form a hollow interior region therebetween, and a partition wall extending from the horizontal top wall to the U-shaped base wall and substantially bisecting the hollow interior region defined between the horizontal top wall and the U-shaped base wall to provide such step with a substantially B-shaped cross-sectional shape.

10. The step ladder of claim 1, wherein each step unit includes a step, a left step mount located between the left leg and a left end of the step with the step inserted into the step mount and formed to include a fastener-receiving aperture, a left fastener arranged to extend through the fastener-receiving aperture formed in the left mount and to couple the left step mount and the left end of the step to the left leg, a right step mount located between the right leg and a right end of the step with the step inserted into the step mount and formed to include a fastener-receiving aperture, and a right fastener arranged to extend through the fastener-receiving aperture formed in the right step mount and to couple the right step mount and the right end of the step to the right leg, and wherein the step is hollow and includes a horizontal top wall, a U-shaped base wall coupled to the horizontal top wall to form a hollow interior region therebetween, and a partition wall extending from the horizontal top wall to the U-shaped base wall and substantially bisecting the hollow interior region defined between the horizontal top wall and the U-shaped base wall to provide such step with a substantially B-shaped cross-sectional shape.

11. The step ladder of claim 10, wherein each of the left and right legs includes spaced-apart first and second tubular members and a web located between and coupled to the first and second tubular members and formed to include an aperture receiving one of the left and right fasteners therein, the left step mount is arranged to abut the first and second tubular members of the left leg, and the right step mount is arranged to abut the first and second tubular members of the right leg.

12. The step ladder of claim 10, wherein a rear portion of the U-shaped base wall is coupled to a rear edge of the horizontal top wall and cooperates with the horizontal top wall to define an acute included angle therebetween.

13. The step ladder of claim 12, wherein a front portion of the U-shaped base wall is coupled to a front edge of the horizontal top wall and cooperates with the horizontal top wall to define an acute included angle therebetween.

14. The step ladder of claim 13, wherein the front and rear portions of the U-shaped base wall are arranged to diverge in a direction toward the horizontal top wall.

15. A step ladder comprising a front frame portion including a left leg and a right leg, each of the left and right legs of the front frame portion including first and second tubular members and a front web located between and coupled to each of the first and second tubular members, a rear frame portion mounted for movement relative to the front frame portion between an expanded position supporting the front frame portion in an inclined position and a collapsed position lying alongside the front frame portion, the rear frame portion including a left leg pivotably coupled to the left leg of the front frame portion and a right leg pivotably coupled to the right leg of the front frame portion, each of the left and right legs of the rear frame portion including third and fourth tubular members and a rear web located between and coupled to each of the third and fourth tubular members, and a plurality of step units arranged to lie between the left and right legs of the front frame portion, each step unit being coupled to the left and right legs of the front frame portion to support said step unit in a fixed position relative to the left and right legs of the front frame portion, wherein each of the first, second, third, and fourth tubular members of the left legs of the front and rear frame portions include first, second, third, and fourth side walls arranged in series to define an interior region therebetween and wherein the first side walls of said first, second, third, and fourth tubular members lie in coextensive relation with a first reference plane, the second side walls of said first and second tubular members are coupled to the front web, the second side walls of said third and fourth tubular members are coupled to the rear web, the third side walls of said first and second tubular members lie in coextensive relation with a second reference plane that is oriented to cooperate with the first reference plane to define a first acute included angle therebetween, the third side walls of said third and fourth tubular members lie in coextensive relation with a fifth reference plane that is oriented to cooperate with the first reference plane to define a third acute included angle therebetween and to cooperate with the second reference plane to define an obtuse included angle therebetween.

16. The step ladder of claim 15, wherein each of the front and rear webs is oriented to lie in a single plane.

17. The step ladder of claim 15, wherein each of the front and rear webs is oriented to lie in offset relation to a central reference plane bisecting the second side walls of the first, second, third, and fourth tubular members.

* * * * *